US005235381A

United States Patent [19]

Namiki et al.

[11] Patent Number: 5,235,381

[45] Date of Patent: Aug. 10, 1993

[54] ROTATION CONTROLLING APPARATUS

[75] Inventors: Hiroaki Namiki, Kawasaki; Kazuhide Kudo, Higashimurayama, both of Japan

[73] Assignee: Canon Kabushiki Kaisha, Tokyo, Japan

[21] Appl. No.: 812,283

[22] Filed: Dec. 23, 1991

[30] Foreign Application Priority Data

Dec. 26, 1990 [JP] Japan ..... 2-406679

[51] Int. Cl.[5] ..... G03B 27/58

[52] U.S. Cl. ..... 355/72; 271/256; 355/321

[58] Field of Search ..... 355/308, 321, 50, 72; 271/4, 8.1, 18, 109, 114, 256

[56] References Cited

U.S. PATENT DOCUMENTS

| | | | |
|---|---|---|---|
| 4,155,545 | 5/1979 | Yanagawa et al. | 271/10 |
| 4,354,759 | 10/1982 | Bujese | 355/3 |
| 4,586,813 | 5/1986 | Ide | 355/50 |
| 5,019,840 | 5/1991 | Watanabe et al. | 355/308 X |
| 5,166,740 | 11/1992 | Tanahashi et al. | 355/321 |

FOREIGN PATENT DOCUMENTS 2338882 8/1977 France .

*Primary Examiner*—Richard A. Wintercorn

*Attorney, Agent, or Firm*—Fitzpatrick, Cella, Harper & Scinto

[57] ABSTRACT

The present invention provides a rotation controlling apparatus for controlling the rotation generated in a rotation drive source and transmitting the rotation to an output portion, comprising a first rotation transmitting member which is connected to the rotation drive source and to which the rotation is transmitted from the rotation drive source; a second rotation transmitting member for transmitting the rotation from the rotation drive source to the output portion when it is engaged by the first rotation transmitting member; a support means adapted to support one of the first and second rotation transmitting members and movable to cause it to be engaged by or disengaged from the other rotation transmitting member; a trigger means for shifting the support means to engage one of the rotation transmitting members by the other; and a rotation transmission controlling means operated by a rotational force from the second rotation transmitting means to shift the support means, thereby disengaging the first rotation transmitting member from the second rotation transmitting member. The present invention also provides an image forming system having such rotation controlling apparatus.

20 Claims, 7 Drawing Sheets

ROTATION CONTROLLING APPARATUS

BACKGROUND OF THE INVENTION

1. Field of the Invention

The present invention relates to a rotation controlling apparatus for controlling the rotation by utilizing a cam, and a sheet feeding system having such rotation controlling apparatus.

2. Related Background Art

In the past, the control of rotation in a driving mechanism such as rollers was effected by independent control motors, or clutches such as electromagnetic clutches or spring clutches. In a sheet feeding system used in a compact printer or copying machine, since it was required to control one revolution of a rotary element exactly and inexpensively, a spring clutch as shown in FIGS. 10 to 13 has generally been used.

Now, such spring clutch will be fully described.

In FIGS. 10 to 13, a sheet supply roller 101 is mounted on a roller holder 102. The roller holder 102 has a semi-circular cross-section and is fixedly or non-rotatably mounted on a sheet supply shaft 103 by means of a pin and the like (not shown). On the sheet supply shaft 103, there are mounted a rotatable input gear 105 rotated by a rotational force from an external driving system 104, and a boss 106 secured to the sheet supply shaft 103 and slightly spaced apart from the input gear. The input gear 105 and the boss 106 are provided at their confronting ends with cylindrical extensions 105*a*, 106*a*, respectively, having substantially the same diameters, and a spring 107 is mounted around these extensions with a slight gap therebetween. One end of the spring is bent toward an axial direction to be inserted into a hole formed in the boss 106. The spring 107 is so mounted that, when the input gear 105 is rotated, the spring is contracted to be urged against the extensions. The other end of the spring is cocked radially outwardly, so that it is engaged by a control ring 108 extending between and rotatably mounted around inner shoulders 105*b*, 106*b* of the input gear 105 and of the boss 106. The control ring 108 is provided at its peripheral surface with a pawl 108*a* by which a flapper 110 mounted on a solenoid 109 can be engaged. When the solenoid 109 is turned OFF, the flapper 110 is engaged by the pawl 108*a*, whereas, when the solenoid is turned ON, the flapper is disengaged from the pawl.

With this arrangement, when the solenoid 109 is turned OFF, since the spring 107 can be contracted inwardly toward the extension 105*a* of the input gear 105, the spring 107 tends to move together with the input gear. However, since the rotation of the end of the spring is regulated by the flapper 110 via the control ring 108, as shown in FIG. 13, the spring 107 is loosened until the spring 107 and the input gear 105 are slipped relative to each other, and, thereafter, this condition is maintained (clutch-off condition).

On the other hand, when the solenoid 109 is turned ON, since the flapper 110 is disengaged from the control ring 108, the spring 107 becomes a free condition. Thus, when the input gear 105 is rotated, the spring 107 is contracted to be firmly urged against the cylindrical extension 105*a* of the input gear 105 as shown in FIG. 12, with the result that the boss 106 is rotated integrally with the input gear 105, thus rotating the sheet supply roller 101 (clutch-on condition). By turning the solenoid 109 OFF again after the turning ON of the solenoid, the rotation of the control ring 108 is regulated again after one revolution of the sheet supply shaft 103, so that the rotation of the input gear is not transmitted to the boss. In this way, one revolution of the sheet supply roller is controlled.

However, in the above-mentioned conventional technique, since the spring 107 is always slidingly contacted with the cylindrical extension 105*a*, the following problems arose.

(1) Since the spring 107 acting as a driving force transmitting portion is slid on the cylindrical extension 105*a*, there arises a problem regarding the wear. Thus, the hardness of surfaces of the spring and the cylindrical extension must be adjusted, or the spring and the cylindrical extension must be made of special material such as sintered alloy.

(2) In order to turn the clutch ON and OFF smoothly, the proper lubricant must be applied on the cylindrical extension 105*a*.

(3) The proper clearance must be provided between the spring 107 and the cylindrical extension 105*a*.

If any one of these requirements (1)–(3) is insufficient, since the torque becomes unbalance, the spring clutch will generate unacceptable noise, poor torque transmission (slip) and/or sequential movement. Further, since the special material must be used, the apparatus is made expensive. Further, the assembling the adjustment of the apparatus become very difficult.

SUMMARY OF THE INVENTION

The present invention aims to eliminate the aforementioned conventional drawbacks, and an object of the present invention is to provide a rotation controlling apparatus wherein it is no need to use the expensive parts, and the setting is easy and any adjustment is not required.

According to the present invention, there is provided a rotation controlling apparatus for controlling the rotation generated in a rotation drive source and transmitting the rotation to an output portion, comprising: a first rotation transmitting member which is connected to the rotation drive source and to which the rotation is transmitted from the rotation drive source; a second rotation transmitting member for transmitting the rotation from the rotation drive source to the output portion when it is engaged by the first rotation transmitting member; a support means adapted to support one of the first and second rotation transmitting members and movable to cause it to be engaged by or disengaged from the other rotation transmitting member; a trigger means for shifting the support means to engage one of the rotation transmitting members by the other; and a rotation transmission controlling means operated by a rotational force from the second rotation transmitting means to shift the support means, thereby disengaging the first rotation transmitting member from the second rotation transmitting member.

With this arrangement, when the first rotation transmitting member is engaged by the second rotation transmitting member by the trigger means, the rotation is transmitted from the rotation drive source to the output portion, and, when the first rotation transmitting member is disengaged from the second rotation transmitting member by the rotation transmission controlling means, the rotation from the rotation drive source is not transmitted to the output portion. Further, since the support means is shifted by utilizing the rotational force of the second rotation transmitting member, when the first rotation transmitting member is disengaged from the second rotation transmitting member by the rotation transmission controlling means, the rotation is not transmitted to the second rotation transmitting member, and thus, the rotation is not transmitted to the rotation transmission controlling means, too, thereby stopping the support means, so that the transmission of the rotation from the rotation drive source to the output portion is automatically blocked.

Preferably, the rotation transmission controlling means comprises a rotatable cam member having a first cam surface by which the support means can be slidingly contacted and adapted to engage the first rotation transmitting member by the second rotation transmitting member, and a second cam surface for separating the first rotation transmitting member from the second rotation transmitting member.

The cam member is rotated by the rotational force of the second rotation transmitting member, and, when the support means is slidingly contacted by the first cam surface, the first rotation transmitting member is engaged by the second rotation transmitting member to transmit the rotation therebetween, and, when the support means is slidingly contacted by the second cam surface, the first rotation transmitting member is disengaged from the second rotation transmitting member thereby not to transmit the rotation therebetween.

From this condition, when the support means is shifted from the second cam surface to the first cam surface by the trigger means, the first rotation transmitting member is engaged by the second rotation transmitting member again, thus transmitting the rotation from the rotation drive source to the output portion.

DETAILED DESCRIPTION OF THE PREFERRED EMBODIMENTS

Figure 1:
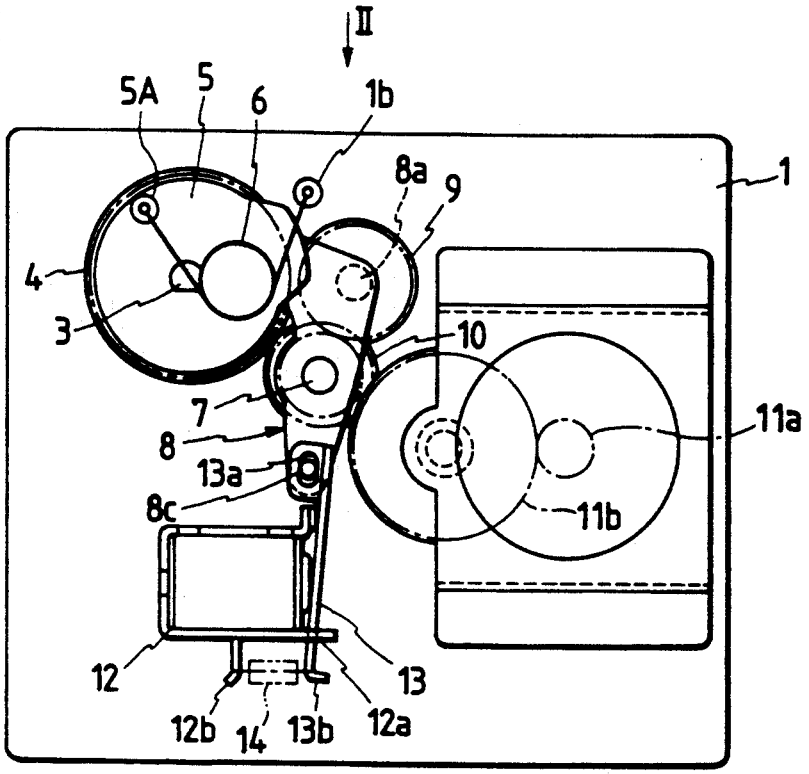
FIG. 1 is an elevational sectional view of a rotation controlling apparatus according to a first embodiment of the present invention.
Figure 2:
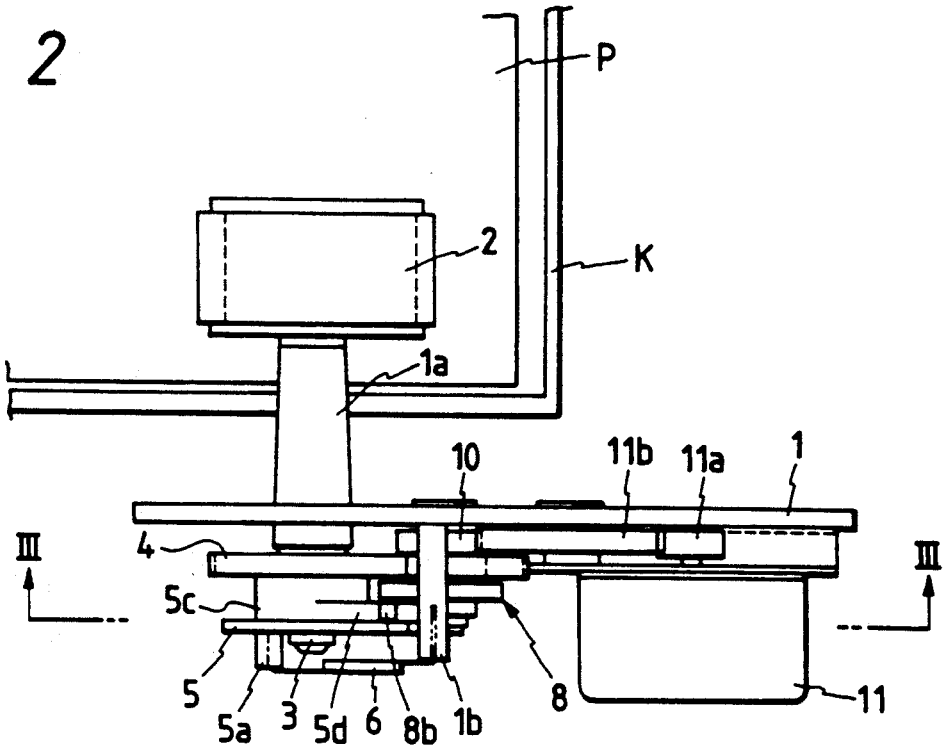
FIG. 2 is a view looked at from a direction shown by the arrow II in FIG. 1.

A first embodiment of the present invention is shown in FIGS. 1 to 5. FIG. 1 is an elevational sectional view of a rotation controlling apparatus according to the first embodiment of the present invention, FIG. 2 is a view looked at from a direction shown by the arrow II in FIG. 1, and FIGS. 3 to 5 are views showing operating conditions.

In FIGS. 1 to 5, a semi-circular sheet supply roller 2 is mounted on a free end of a boss 1*a* uprightly extending from a base frame 1 of the rotation controlling apparatus. A sheet supply shaft 3 extends through the boss 1*a* and protrudes from the base frame 1 to an opposite direction, and a sheet supply gear 4 and a sheet supply cam 5 are integrally mounted on the protruded portion of the sheet supply shaft 3. A cylindrical boss portion 5A is formed on a peripheral surface of the sheet supply cam 5, and a spring 6 is arranged between the cylindrical boss 5A and a cylindrical boss 1*b* protruding from the base frame 1 opposite to the sheet supply roller 2 to bias the sheet supply cam 5 in an anti-clockwise direction in FIG. 1.

Figure 3:
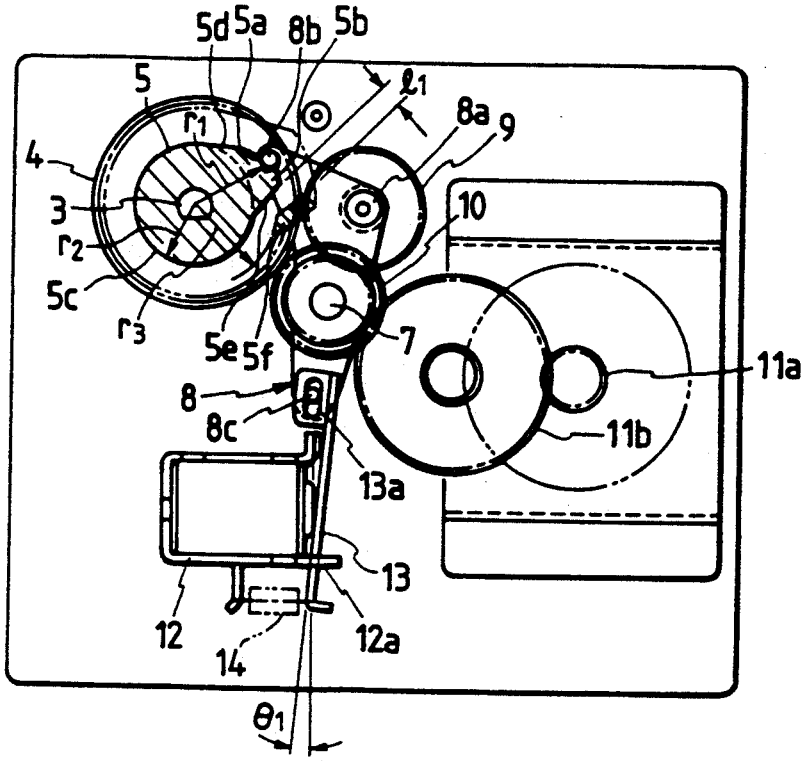
FIG. 3 is a sectional view taken along the line III—III in FIG. 2.

On the other hand, as shown in FIG. 3, an inner surface of the sheet supply cam 5 includes a cam surface comprising a surface 5*a* spaced apart from a center of rotation of the cam by a distance $r_1$, a protrusion 5*b* having a substantially vertical wall, a curved surface 5*c* spaced apart from the center of rotation by a distance $r_2$, and an inclined surface 5*d* smoothly connecting the curved surface 5*c* to the surface 5*a*. Further, an inclined wall surface 5*f* is formed to be spaced apart from an inclined portion 5*e* extending between the protrusion 5*b* and the curved surface 5*c* by a distance $l_1$.

On the other hand, a pendulum member 8 is rotatably mounted around a shaft 7. A pendulum gear 9 is rotatably supported by a pin shaft 8*a* formed on the pendulum member 8, and an end of the pendulum member 8 extends toward the cam surface and has a pin 8*b* having a diameter $d_i$ smaller than the distance $l_1$. Similarly, a pin 8*c* having a diameter $d_2$ is formed on the other end of the pendulum 8. On the rotation shaft 7 of the pendulum member 8, there is rotatably supported a gear 10 which is meshed with the pendulum gear 9, and the gear 10 is connected to a motor output gear 11*a* of a motor 11 acting as a rotation drive source via an intermediate gear 11*b*. Further, the pin 8*c* having the diameter $d_2$ and formed on the other end of the pendulum member 8 is fitted into a slot 13*a* formed in an armature 13 of a solenoid 12. The armature 13 is rotatably supported around a frame of the solenoid 12 at 12*a*, and a tension spring 14 is arranged between a hooked portion 13*b* of the armature 13 and a hooked portion 12*b* of the solenoid frame. Thus, when the solenoid 12 is in an OFF condition, the pendulum member 8 is biased so that the pin 8*b* is urged against the cam surface.

Further, the armature 13 is so arranged that, when the pin 8*b* of the pendulum member 8 is abutted against the surface 5*a* of the cam surface, the armature is in a waiting position having an angle $\theta_1$ (FIG. 3) with respect to the solenoid 12. Further, an inner end of the inclined wall surface 5*f* extends to a position spaced apart from the center of rotation of the cam by a distance $r_3$. The distance $r_3$ must be set to satisfy a relation $(r_3-r_2)\leqq(d_1+2m)$, where m is module.

Figure 14:
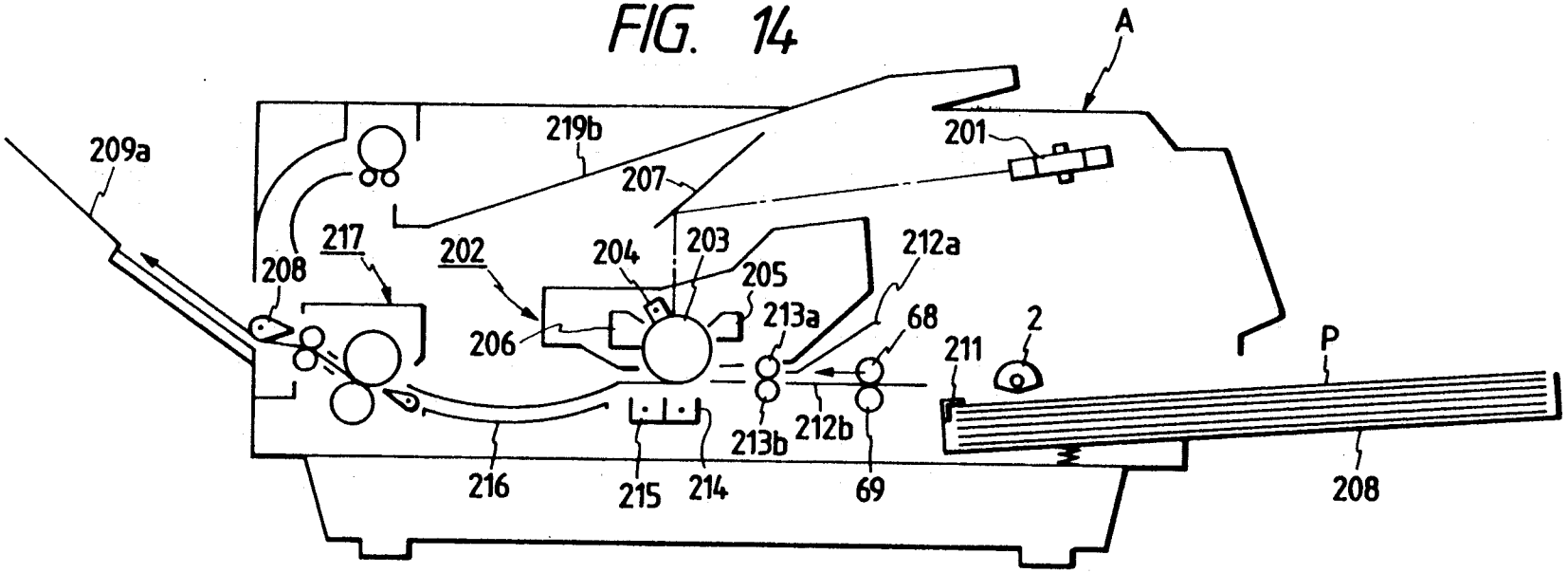
FIG. 14 is an elevational sectional view of an image forming system using the rotation controlling apparatus according to the present invention.
Figure 15:
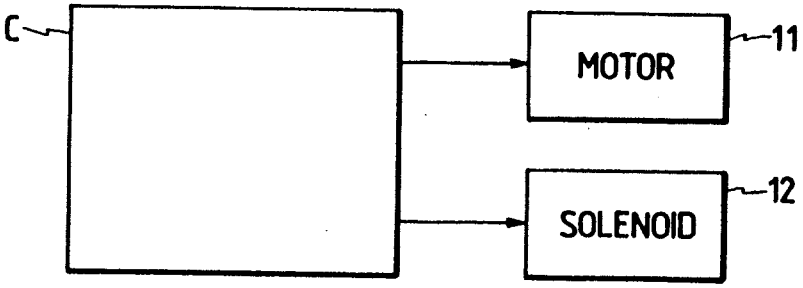
FIG. 15 is a block diagram of a control means used in the system of FIG. 14.

Incidentally, the ON/OFF control of the motor 11 and the solenoid 12 is effected on the basis of signals from a control means C (FIG. 15) of an image forming system A (FIG. 14).

Figure 4:
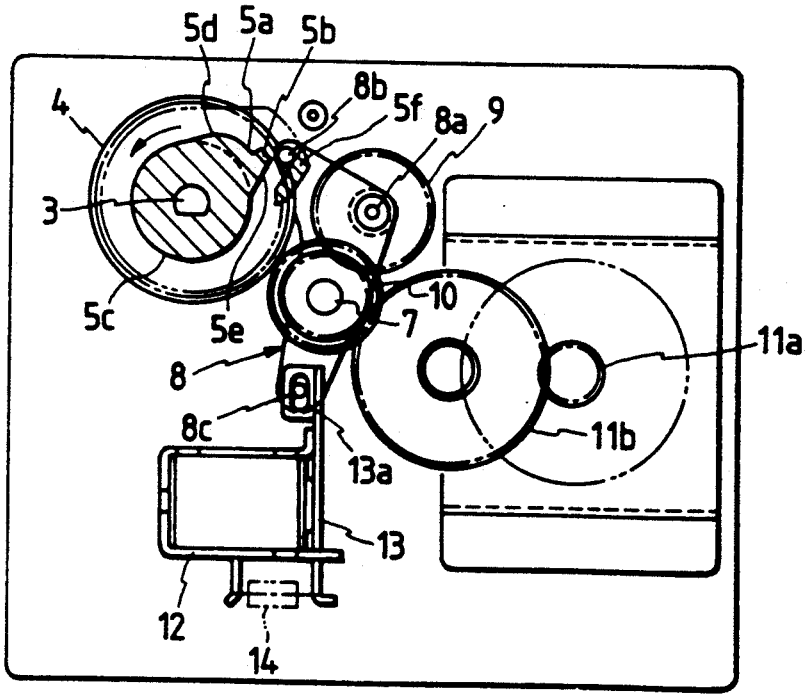
FIG. 4 is an elevational sectional view similar to FIG. 1, showing an operating condition.
Figure 5:
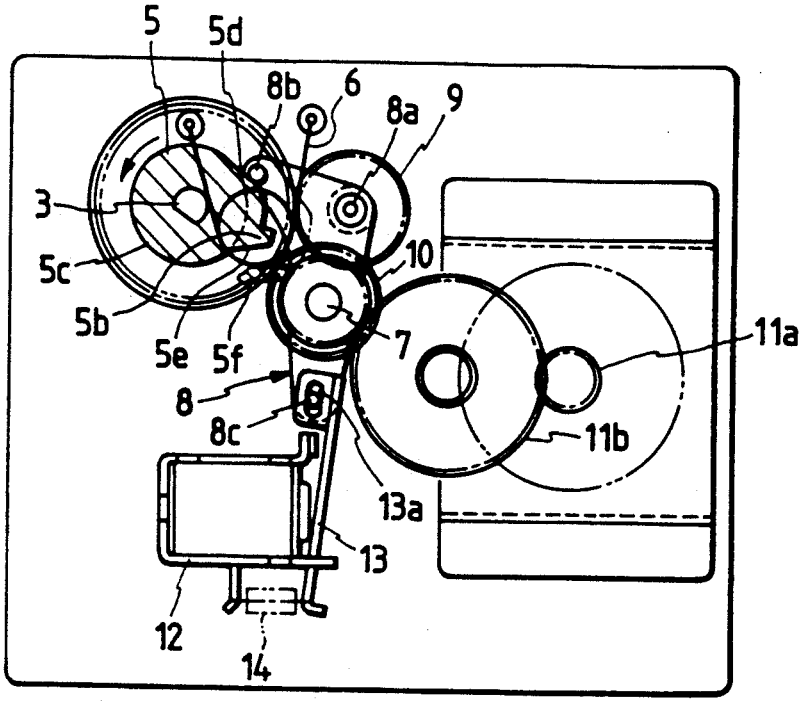
FIG. 5 is an elevational sectional view similar to FIG. 1, showing another operating condition.

With the arrangement as mentioned above, when a sheet supply command is emitted from the control means C, first of all, the solenoid 12 is turned ON to attract the armature 13. Consequently, as shown in FIG. 4, the pin 8*b* of the pendulum member 8 is separated from the cam surface 5*a* and is stopped at a position higher than the top of the cam protrusion 5*b*. Thus, the sheet supply cam 5 is rotated in the anti-clockwise direction by the spring 6 until the pin 8*b* of the pendulum member 8 is abutted against the inclined wall surface 5*f*.

Then, when the solenoid 12 is turned OFF, the pin 8*b* of the pendulum member 8 is shifted to the cam surface 5*c* through between the inclined portions 5*e* and 5*f* by means of the return spring 14 of the solenoid 12. Now, since there is the relation $(r_3-r_2)\leqq(d_1+2m)$, as soon as or immediately before the pin 8*b* is separated from the inclined wall surface 5*f*, the pendulum gear 9 is meshed with the sheet supply gear 4. Then, when the pin 8*b* is abutted against the cam surface 5*c*, the smooth drive transmission is permitted, since the diameter $d_1$ and position of the pin 8*b* are so set as to provide a proper backlash.

Then, the sheet supply cam 5 and the sheet supply roller 2 are rotated by a driving force from the motor 11. When the pin 8*b* is shifted from the cam surface 5*c* to the inclined portion 5*d*, the meshing amount between the pendulum gear 9 and the sheet supply gear 4 is gradually decreased. When such meshing amount becomes zero, the pin 8*b* is abutted against the cam protrusion 5*b* again by the force of the spring 6, so that the sheet supply cam 5 and the sheet supply roller 2 are stopped at their original positions after one revolution. Accordingly, it is possible to perform the one revolution control of the sheet supply roller 2 without stopping the motor 11.

Thus, it is possible to feed out a sheet one by one from a cassette K (FIG. 2) stacking sheets P, by intermittently rotating the sheet supply roller 2. Further, as mentioned above, the ON/OFF control of the solenoid 12 is effected by the control means C provided in the image forming system A (FIG. 14).

Incidentally, in the illustrated embodiment, while the sheet supply cam 5 was secured to the sheet supply shaft 3 acting as an rotation output portion, the sheet supply gear 4 may be meshed with an additional gear which is secured to the sheet supply shaft so that the rotation is outputted from the sheet supply gear. In this case, it is possible to optionally set the number of output rotation in accordance with the gear ratio between the sheet supply gear and the additional gear.

Figure 6:
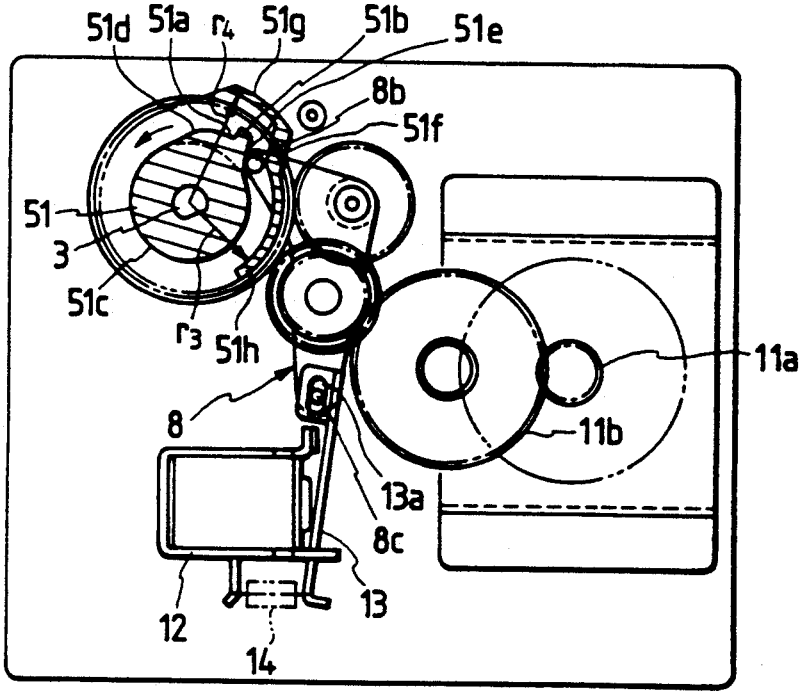
FIG. 6 is an elevational sectional view of a rotation controlling apparatus according to a second embodiment of the present invention.

A second embodiment of the present invention is shown in FIG. 6. This embodiment is similar to the first embodiment, except for the configuration of the cam. Therefore, regarding this embodiment, only the cam configuration is explained, and the detailed explanation of the other parts will be omitted.

A regulating wall surface 51*g* is arranged contiguous to an inclined wall surface 51*f*, which regulating wall surface is spaced apart from the center of rotation of the cam by a distance $r_4$ and is opposed to a cam surface 51*a* spaced apart from the center of rotation by a distance $r_1$. Further, a regulating wall surface 51*h* is arranged contiguous to the other end of the inclined wall surface 51*f* and is spaced apart from the center of rotation of the cam by a distance $r_3$. It should be noted that the distance $r_4$ is so selected that, when the armature 13 is attracted by the solenoid 12, the pin 8*b* of the pendulum member 8 is adequately separated from the rotating range of a cam protrusion 51*b*.

As a result, although the position of the pin 8*b* depends upon the accuracy in attachment of the solenoid 12 in the first embodiment, in the second embodiment, since the pin 8*b* is abutted against the regulating wall surface 51*g*, the accuracy in the attachment of the solenoid 12 can be more relieved and the pin 8*b* can be prevented from being dropped off from a cam 51. Further, since there is provided the regulating wall surface 51*h*, it is possible to prevent the pin 8*b* of the pendulum 8 from falling down from the inclined wall surface 51*f* due to the weak attraction force of the solenoid 12 or the weak biasing force of the spring 6 while the solenoid is in the ON condition, and to prevent the cam 51 from being idly rotated due to the spring force even if the OFF timing of the solenoid 12 is slightly delayed. Incidentally, in this case, a relation $(r_3-r_2)<(d_1+2m)$ must be satisfied.

Figure 7:
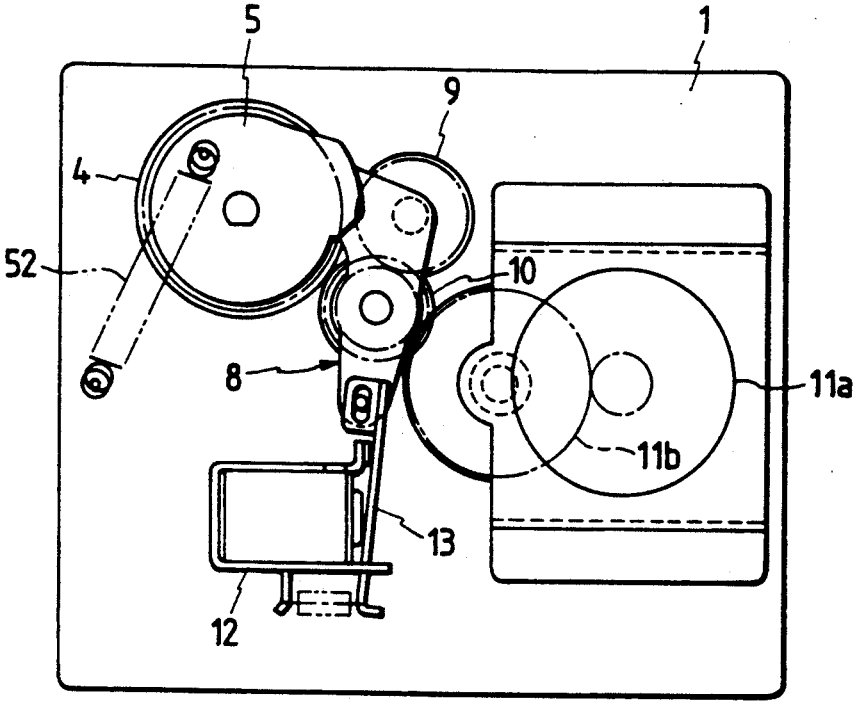
FIG. 7 is an elevational sectional view of a rotation controlling apparatus according to a third embodiment of the present invention.

A third embodiment of the present invention, is shown in FIG. 7.

The third embodiment differs from the first embodiment in the point that a tension spring 52 for affording the initial rotation is used in place of the torsion spring 6. The reason for the provision of the tension spring is that, when the torsion coil spring 6 is used as in the first embodiment, the coils in the spring may be disordered depending upon the number of coils or the coils may be displaced not to provide biasing force (rotating force) depending upon the slope of the spring. In this third embodiment, the tension coil spring 52 is arranged between the base frame 1 and the cam 5 so that the cam can be rotated in the manner as described in the first embodiment, thereby obtaining the stable rotation of the cam.

Figure 8:
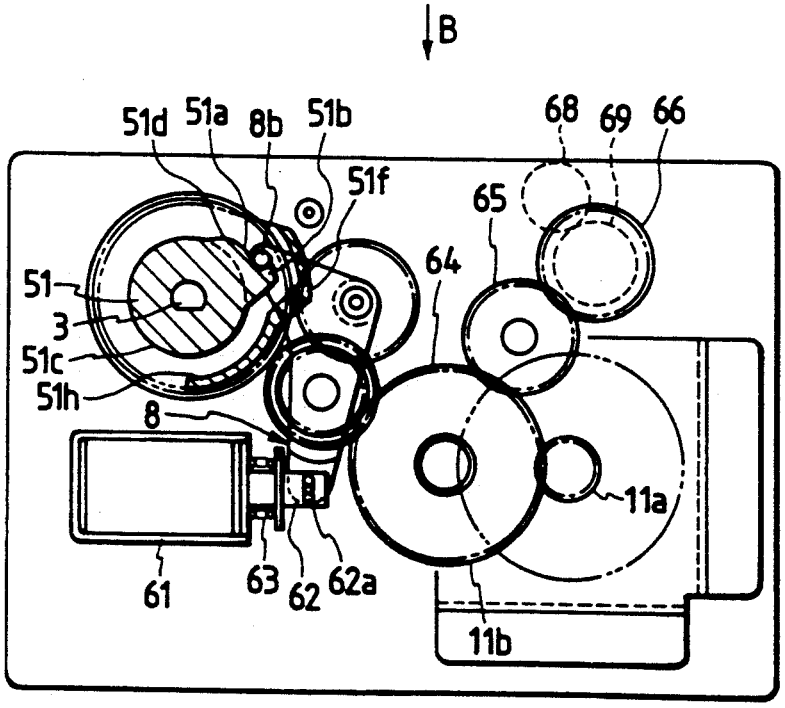
FIG. 8 is an elevational sectional view of a rotation controlling apparatus according to a fourth embodiment of the present invention.
Figure 9:
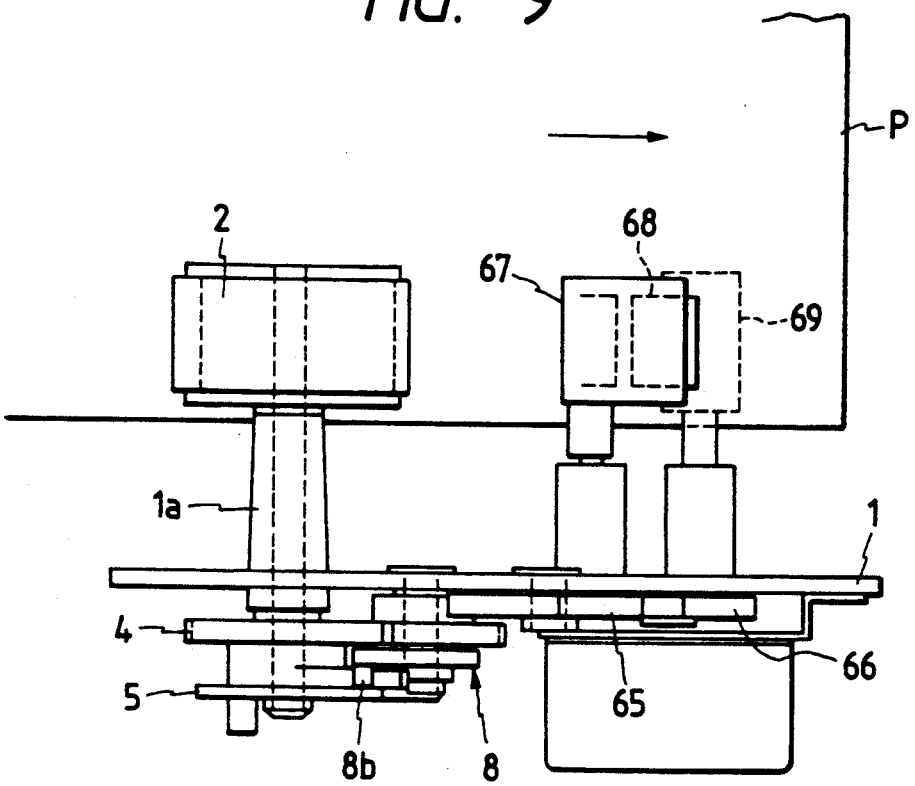
FIG. 9 is a view looked at from a direction shown by the arrow B in FIG. 8.
Figure 10:
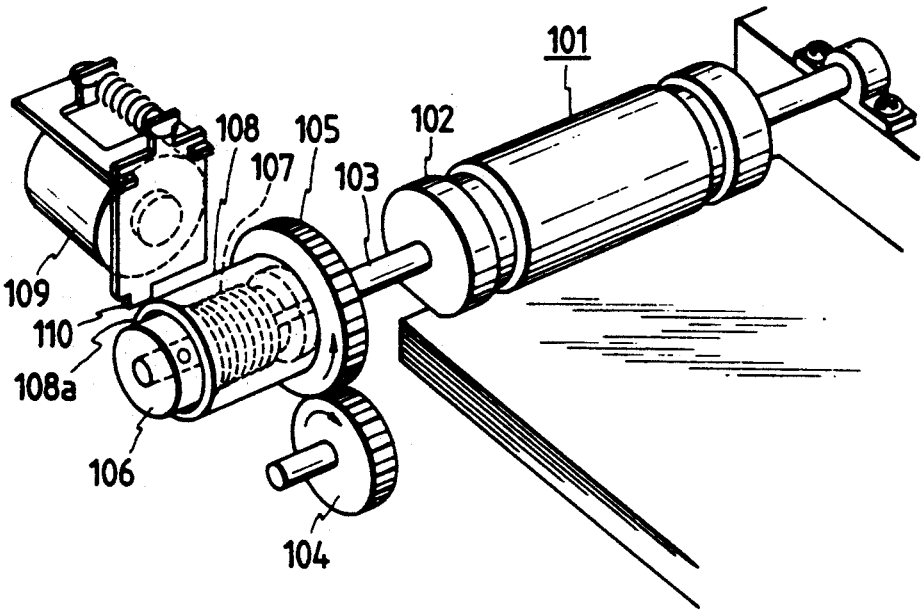
FIG. 10 PRIOR ART
FIG. 10 is a perspective view of a conventional sheet supplying apparatus using a one-revolution clutch.
Figure 11:
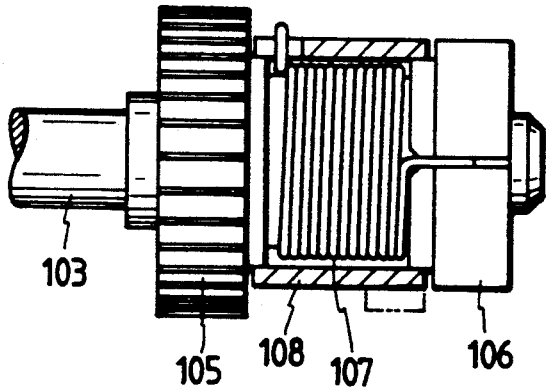
FIG. 11 PRIOR ART
FIG. 11 is an elevational view of the one-revolution clutch of FIG. 10.
Figure 12:
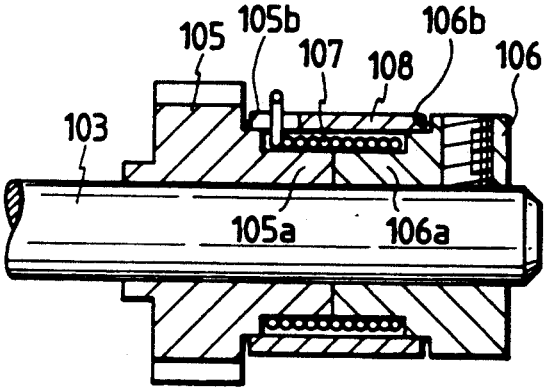
FIG. 12 PRIOR ART
FIG. 12 is an elevational sectional view of the one-revolution clutch of FIG. 10, showing a clutch-on condition.
Figure 13:
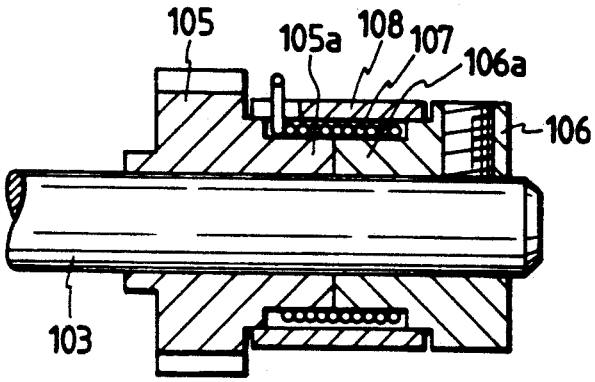
FIG. 13 PRIOR ART
FIG. 13 is an elevational sectional view of the one-revolution clutch of FIG. 10, showing a clutch-off condition.

A fourth embodiment of the present invention is shown in FIGS. 8 and 9. This fourth embodiment differs from the second embodiment in the following points. That is to say, as the solenoid, a solenoid 61 of plunger type is used and a plunger 62 of the solenoid has a return spring 63 mounted thereon and is connected to the pendulum member 8 at 62*a*. On the other hand, in another drive system from the motor gear 11*a*, there is disposed a feed gear 66 connected to the motor gear via idler gears 64, 65, and a feed roller 69 rotated integrally with the feed gear 66 extends toward a downstream side of the sheet supply roller 2. Another feed roller 68 held by a roller holder 67 is urged against the feed roller 69 with a predetermined pressure. With this arrangement, the sheet P can be picked up one by one by means of the sheet supply roller 2 and can be fed by the feed roller 69 without stopping it.

Incidentally, the present invention is not limited to the above-mentioned embodiments. For example, the cam configuration and/or position of the solenoid may be changed in accordance with their uses. Further, in the illustrated embodiments, while examples that the present invention is applied to a sheet supplying apparatus of the image forming system such as a printer, copying machine and the like were explained, the present invention is not limited to such examples, but can be applied to any systems wherein one revolution should be controlled. Further, in the illustrated embodiments, while one revolution control was explained, ½ revolution or ⅓ revolution may be controlled by appropriately selecting the cam surface.

As mentioned above, since the rotation is transmitted to the cam and the transmission of the rotation to the cam is controlled by the cam surface of the cam to thereby output the rotation, the present invention provides the following advantages:

(1) Contrary to the conventional technique, since the wear cannot be considered, the special material and working are not required.

(2) Contrary to the conventional technique, the maintenance such as application of lubricant and adjustment is not required at all.

(3) Since the reduction in cost of material, number of parts and number of working steps can be achieved and the adjustment is not required, the apparatus can be made more inexpensive than the conventional apparatuses.

(4) Since the transmission is effected by meshing the gears, the transmission torque can be increased.

(5) Since the rotation can surely be stopped, the noise can be eliminated and the over-rotation or continuous rotation does not occur.

Next, a laser beam printer embodying an image forming system according to the present invention having a sheet supplying means including the rotation controlling apparatus will be briefly described with reference to FIG. 14.

The laser beam printer comprises a scanner unit 201 for illuminating and scanning a laser beam in accordance with image information, and a process cartridge 202 including therein a photosensitive drum (image bearing member) 203, a primary charger (corona discharger) 204, a developing device 205 containing toner therein, and a cleaner 206.

The laser beam emitted from the scanner unit 201 is incident to the photosensitive drum 203 in the process cartridge 202 via a reflection mirror 207. The photosensitive drum 203 is previously charged by the primary charger 204, and thus, when the laser beam is illuminated on the photosensitive drum, an electrostatic latent image is formed on the drum. The latent image is then visualized by the developing device 205 to form a toner image.

On the other hand, sheets P fed out from a sheet supply cassette 208 by means of a sheet supply roller (sheet supply rotary member) 2 are separated one by one by means of pawl members 211 formed on the sheet supply cassette 208. The separated sheet P is guided between upper and lower guide plates 212*a*, 212*b* to reach a pair of regist rollers 213*a*, 213*b* temporarily stopped, where the skew-feed of the sheet is corrected. Then, the sheet P is fed to a transfer station by the paired regist rollers 213*a*, 213*b* in synchronous with a leading end of the toner image formed on the photosensitive drum 203.

The transfer station includes a transfer charger 214 for transferring the toner image formed on the photosensitive drum 203 onto the sheet P. The back of the sheet P is charged by the transfer charger 214 with the charging polarity opposite to that of the toner, so that the toner image is transferred onto the sheet P. After the toner image has been transferred to the sheet P, the latter is charged by a separating charger 215 with the polarity opposite to that of the transfer charger 214 and then is separated from the photosensitive drum 203. The residual toner remaining on the photosensitive drum 203 is removed by the cleaner 206 for preparation for the next image formation.

On the other hand, the sheet P separated from the photosensitive drum is sent to a fixing device 217 by means of a conveying means 216. In the fixing device 217, the transferred toner image is permanently fixed to the sheet P. Then, the sheet P is ejected onto an external ejection tray 219*a* or an internal ejection tray 219*b* through a feed path selected by a flapper 218.

We claim:

1. A rotation controlling apparatus for controlling the rotation generated in a rotation drive source and transmitting the rotation to an output portion, comprising:

a first rotation transmitting member which is connected to said rotation drive source and to which the rotation is transmitted from said rotation drive source;

a second rotation transmitting member for transmitting the rotation from said rotation drive source to said output portion when it is engaged by said first rotation transmitting member;

a support means adapted to support one of said first and second rotation transmitting members and movable to cause it to be engaged by or disengaged from the other rotation transmitting member;

a trigger means for shifting said support means to engage one of said rotation transmitting members by the other; and a rotation transmission controlling means operated by a rotational force from said second rotation transmitting means to shift said support means, thereby disengaging said first rotation transmitting member from said second rotation transmitting member.

2. A rotation controlling apparatus according to claim 1, wherein said rotation transmission controlling means comprises a cam member rotated by the rotational force from said second rotation transmitting member; and said cam member has a cam surface including a first cam surface adapted to be slidingly contacted by said support means to engage said first rotation transmitting member by said second rotation transmitting member, and a second cam surface adapted to be slidingly contacted by said support means to separate said first rotation transmitting member from said second rotation transmitting member.

3. A rotation controlling apparatus according to claim 2, wherein said cam member has a third cam surface for changing the sliding contact position of said support means from said first cam surface to said second cam surface during the rotation of said cam member.

4. A rotation controlling apparatus according to claim 3, wherein, when said support means is contacted by said second cam surface, said first rotation transmitting member is disengaged from said second rotation transmitting member not to transmit the rotation therebetween, thereby stopping said cam member.

5. A rotation controlling apparatus according to claim 4, wherein said trigger means shifts the sliding contact position between said support means and said cam member from said second cam surface to said first cam surface.

6. A rotation controlling apparatus according to claim 5, wherein said trigger means comprises a rotation biasing means for biasing said cam member toward a rotational direction thereof, a stopping means for stopping said cam member in opposition to a biasing force of said rotation biasing means, and a releasing means for releasing the stoppage of said cam member by means of said stopping means; and wherein, when said releasing means releases the stoppage of said cam member by means of said stopping means, said cam member is rotated by said rotation biasing means, so the sliding contact position of said support means is changed from said second cam surface to said first cam surface, thereby engaging said first rotation transmitting member by said second rotation transmitting member to transmit the rotation therebetween.

7. A rotation controlling apparatus according to claim 6, wherein said stopping means comprises a protrusion formed on said cam member, and a projection formed on said support means and engageable by said protrusion; and said releasing means comprises a solenoid for rocking said support means to disengage said projection from said protrusion.

8. A rotation controlling apparatus according to claim 2, wherein said first rotation transmitting member and said cam member are connected to an output shaft of said output portion.

9. A rotation controlling apparatus according to claim 1, wherein said first and second rotation transmitting members comprise gears which can be meshed with each other.

10. A rotation controlling apparatus according to claim 1, wherein said support means comprises a rockable pendulum member supporting said rotation transmitting member.

11. A rotation controlling apparatus for controlling the rotation generated in a rotation drive source and transmitting the rotation to an output portion, comprising:

a first gear supported by a rockable support means;

a transmitting means for transmitting the rotation of said rotation drive source to said first gear;

a second gear connected to an output shaft of said output portion and adapted to transmit the rotation of said rotation drive source to said output shaft when it is engaged by said first gear;

a cam member connected to said output shaft and having a first cam surface capable of slidingly contacting by said support means to engage said first gear by said second gear, and a second cam surface capable of slidingly contacting by said support means to disengage said first gear from said second gear; and trigger means for shifting the sliding contact position between said support means and said cam member from said second cam surface to said first cam surface.

12. A rotation controlling apparatus according to claim 11, wherein said cam member receives the rotation from said rotation drive source via said output shaft to rotate, when said first gear is engaged by said second gear.

13. A rotation controlling apparatus according to claim 12, further including a biasing means for biasing said support means toward a position where said first gear is engaged by said second gear.

14. A rotation controlling apparatus according to claim 13, wherein said cam member has a third can surface for changing the sliding contact position of said support means from said first cam surface to said second cam surface during the rotation of said cam member.

15. A rotation controlling apparatus according to claim 14, wherein said trigger means comprises a rotation biasing means for biasing said cam member toward a rotational direction thereof, a stopping means for stopping said cam member in opposition to a biasing force of said rotation biasing means, and a releasing means for releasing the stoppage of said cam member by means of said stopping means; and wherein, when said releasing means releases the stoppage of said cam member by means of said stopping means, said cam member is rotated by said rotation biasing means, so that the sliding contact position of said support means is changed from said second cam surface to said first cam surface, thereby engaging said first gear by said second gear to transmit the rotation therebetween.

16. A rotation controlling apparatus according to claim 15, wherein said stopping means comprises a protrusion formed on said cam member, and a projection formed on said support means and engageable by said protrusion; and said releasing means comprises a solenoid for rocking said support means to disengage said projection from said protrusion.

17. A rotation controlling apparatus according to claim 11, wherein said transmitting means comprises a gear train, and one of gears in said gear train is disposed on a pivot shaft of said support means.

18. An image forming system comprising:

a rotation controlling apparatus including (a) a first rotation transmitting member which is connected to a rotation drive source and to which the rotation is transmitted from said rotation drive source;

(b) a second rotation transmitting member for transmitting the rotation from said rotation drive source to an output portion when it is engaged by said first rotation transmitting member;

(c) a support means adapted to support one of said first and second rotation transmitting members and movable to cause it to be engaged by or disengaged from the other rotation transmitting member;

(d) a trigger means for shifting said support means to engage one of said rotation transmitting members by the other; and (e) a rotation transmission controlling means operated by a rotational force from said second rotation transmitting means to shift said support means, thereby disengaging said first rotation transmitting member from said second rotation transmitting member;

a sheet stacking means for stacking sheets;

a rotary sheet supply means connected to said output portion and rotated by the rotational force of said second rotation transmitting member to feed out the sheets from said sheet stacking means; and an image forming means for forming an image on the sheet fed by said rotary sheet supply means.

19. An image forming system according to claim 18, wherein said rotation transmission controlling means comprises a cam member rotated by the rotational force from said second rotation transmitting member; and said cam member has a first cam surface adapted to be slidingly contacted by said support means to engage said first rotation transmitting member by said second rotation transmitting member, and a second cam surface adapted to be slidingly contacted by said support means to separate said first rotation transmitting member from said second rotation transmitting member.

20. An image forming system according to claim 19, wherein said rotation drive source also drives a feed means for feeding the sheet fed by said rotary sheet supply means to said image forming means.

* * * * *

UNITED STATES PATENT AND TRADEMARK OFFICE

CERTIFICATE OF CORRECTION

PATENT NO. : 5,235,381

DATED : August 10, 1993

INVENTOR(S) : Kiroaki NAMIKI, et al.

It is certified that error appears in the above-indentified patent and that said Letters Patent is hereby corrected as shown below:

Column 1

Line 19, "spring" should read --a spring--; and

Line 31, "having" should read --both having--.

Column 2

Line 25, "the special" should read --special--;

Line 26, "the assembling" should read --both the assembling and--;

Line 33, "it" should read --there--; and "the" should be deleted; and

Line 34, "any" should read --no--; and "not" should be deleted.

Column 3

Line 27, "to transmit" should read --transmitting--.

Column 4

Line 12, "invention," should read --invention.--; and

Line 28, "an anti-clockwise" should read --a counter-clockwise--.

Column 5

Line 15, "anti-clockwise" should read --counter-clockwise--;

Line 52, "an" should read --a--; and

Line 56, "rotation" should read --rotations--.

UNITED STATES PATENT AND TRADEMARK OFFICE

CERTIFICATE OF CORRECTION

PATENT NO. : 5,235,381

DATED : August 10, 1993

INVENTOR(S) : Kiroaki NAMIKI, et al.

It is certified that error appears in the above-indentified patent and that said Letters Patent is hereby corrected as shown below:

Column 6

Line 15, "more relieved" should read --relaxed--;
Line 36, "displaced not to provide" should read --displaced and not provide a--;
Line 46, "as the solenoid," should be deleted;
Line 65, "to a" should read --to are of a--; and
Line 67, "like were explained," should read --like,--.

Column 7

Line 12, "the" should be deleted;
Line 15, "application" should read --the application--;
Line 17, "the" should read --a--;
Line 20, "more inexpensive" should read --less expensive--;
Line 24, "the noise" should read --noise--;
Line 25, "the" should be deleted;
Line 54, "regist" should read --registration--; and
Line 57, "regist" should read --registration--; and "synchronous" should read --synchronism--.

Column 8

Line 5, "separated" should read --that is separated--;
Line 15, "comprising:" should read --said rotation control apparatus comprising:--; and
Line 57, "not" should read --so as not--.

UNITED STATES PATENT AND TRADEMARK OFFICE

CERTIFICATE OF CORRECTION

PATENT NO. : 5,235,381

DATED : August 10, 1993

INVENTOR(S) : Kiroaki NAMIKI, et al.

It is certified that error appears in the above-indentified patent and that said Letters Patent is hereby corrected as shown below:

Column 9

Line 6, "so" should read --so that--;

Line 32, "portion," should read --portion, said rotation control apparatus--;

Line 42, "by" should be deleted;

Line 44, "by" should be deleted;

Line 61, "can" should read --cam--.

Signed and Sealed this

Twenty-ninth Day of March, 1994

Bruce Lehman

*Attest:*

BRUCE LEHMAN

*Attesting Officer*

*Commissioner of Patents and Trademarks*